United States Patent [19]

Wilkes et al.

[11] 3,996,635

[45] Dec. 14, 1976

[54] NESTABLE MULTI-SECTION BOAT ASSEMBLY

[76] Inventors: Gerald S. Wilkes; Helen Elaine Wilkes, both of 20736 S. Elaine, Lakewood, Calif. 90715

[22] Filed: July 11, 1975

[21] Appl. No.: 595,223

[52] U.S. Cl. ..... 9/2 S

[51] Int. Cl.[2] ..... B63B 7/00

[58] Field of Search ..... 9/2 R, 2 C, 2 S, 6; 114/77 R

[56] References Cited

UNITED STATES PATENTS

| | | | |
|---|---|---|---|
| 1,916,093 | 6/1933 | Cormier | 9/2 S |
| 2,040,373 | 5/1936 | Green | 9/2 S |
| 2,292,972 | 8/1942 | Rice | 9/2 S |
| 2,443,768 | 6/1948 | House | 9/2 S |
| 2,741,782 | 4/1956 | Muller | 9/2 S |
| 2,977,607 | 4/1961 | Roblee | 9/2 S |
| 3,381,322 | 5/1968 | Cook | 9/2 S |

FOREIGN PATENTS OR APPLICATIONS

| | | | |
|---|---|---|---|
| 1,063,527 | 5/1954 | France | 9/2 S |

*Primary Examiner*—Trygve M. Blix
*Assistant Examiner*—Jesus D. Sotelo
*Attorney, Agent, or Firm*—William C. Babcock

[57] ABSTRACT

A light weight, portable, multi-section boat assembly in which the sections may be transported in a compact, nested configuration to a desired body of water, and the sections upon reaching the body of water capable of being removably interlocked end-to-end to provide a buoyant, stable boat. After the boat has served its intended purpose the sections are disconnected from one another, and returned to their initial, compact, nested configuration for transportation on land via a suitable vehicle.

4 Claims, 7 Drawing Figures

FIG. 1
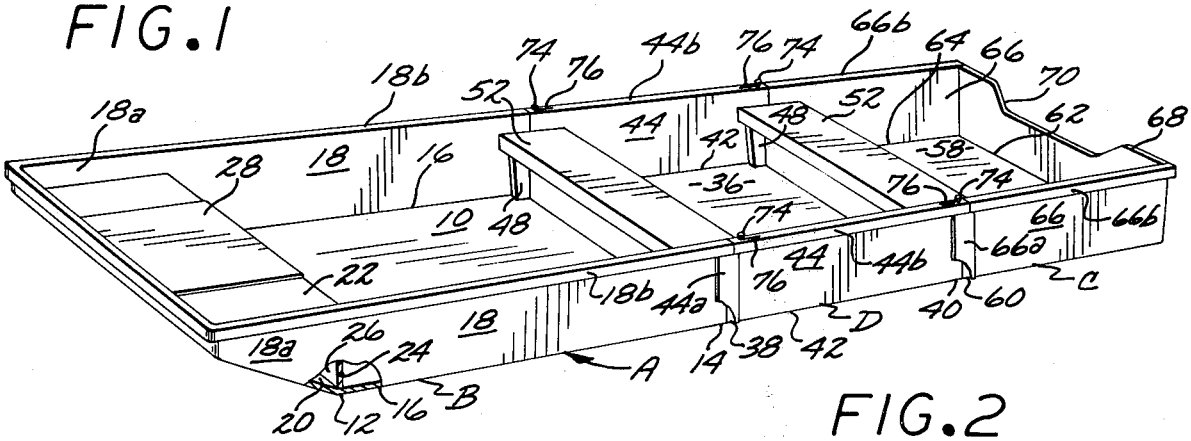
FIG. 2
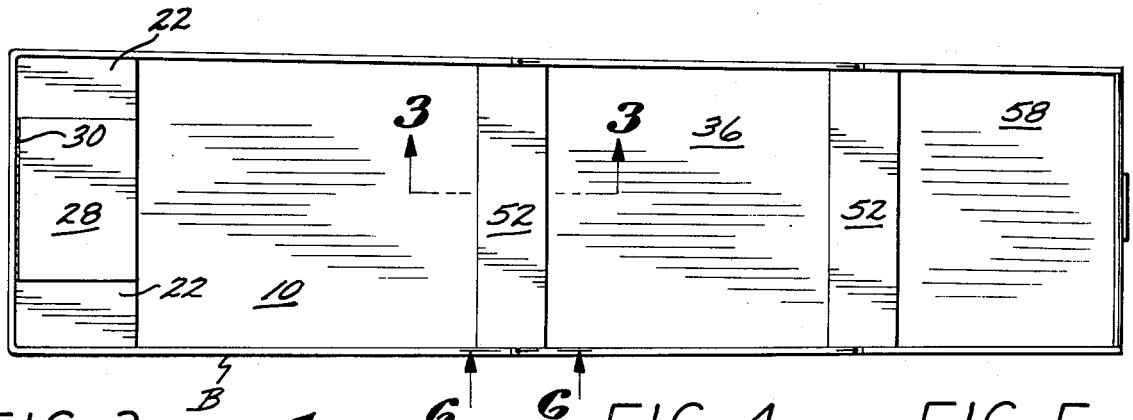
FIG. 3
FIG. 4
FIG. 5
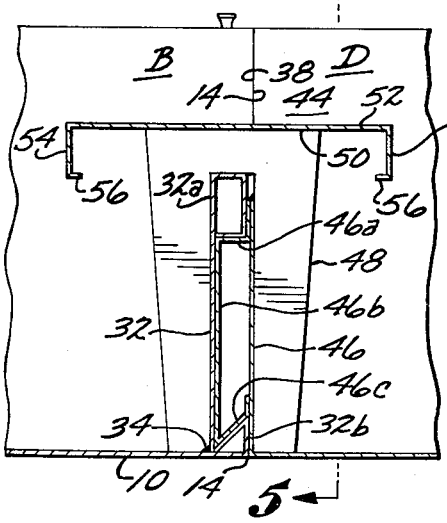
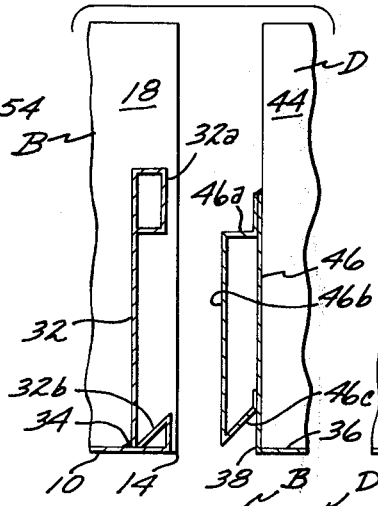
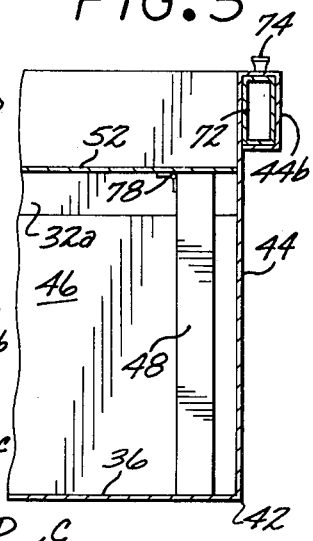
FIG. 6
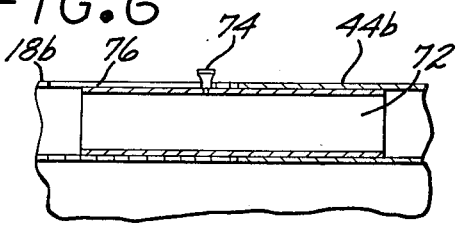
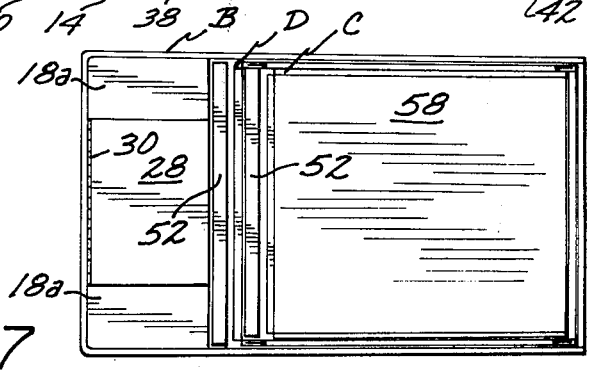
FIG. 7

NESTABLE MULTI-SECTION BOAT ASSEMBLY

BACKGROUND OF THE INVENTION

1. Field of the Invention

Nestable multi-section boat assembly.

2. Description of the Prior Art

In the past, fishermen and other sportsmen that desire a small boat for use on lakes and the like, were forced to carry the boat on a trailer or removably attached in a supported position on an automobile or station wagon. The transportation of boats in the above-described manner is not only inconvenient but hazardous.

A major object of the present invention is to eliminate the inconvenience of transporting a small boat, and this object being achieved by providing a compact, light weight multi-section assembly that is transported to a desired body of water in a nested configuration, and the assembly upon the body of water being reached being expanded by the sections being placed end-to-end and removably interlocked with one another to provide a stable buoyant boat that is particularly adapted for fishing purposes.

Another object of the invention is to supply a multi-section boat assembly that can be fabricated from standard commercially available materials, is inexpensive to produce, simple and easy to use, and one that may be retailed at a sufficiently low price as to encourage the widespread use thereof.

A further object of the invention is to supply a multi-section boat which when either in the nested position or separated into individual components may be used in the home for decorative or storage purposes.

SUMMARY OF THE INVENTION

The invention comprises a light weight assembly of sections capable of nesting one within the other during the transportation thereof, and the sections capable of being disposed end-to-end in interlocking relationship upon a desired body of water being reached. The boat comprises a bow section, a stern section, and at least one intermediate section situated therebetween, with the sections capable of interlocking with one another without the use of hand tools. Each of the sections includes a trapezoidal shaped bottom from which side walls extend upwardly, with the bow section having an upwardly and forwardly extending front end in which a compartment is provided either for bait purpose or the storing of gear. The stern section is provided with a transom on which an outboard motor may be removably mounted if desired. The rearward portion of the bow section and the forward portion of the stern section removably interlock with their intermediate section by a simple manual operation, and the sections being held in rigid end-to-end relationship by inverted U-shape members that removably engage the interlocking portions of the sections, and the U-shape members also serving the dual function of providing seats for the user of the boat when the latter is floating on a body of water. The bow, stern and intermediate sections are formed with longitudinally aligned hollow rails, and the rails interlocking with one another to provide longitudinal rigidity to the assembled boat by slides that engage the hollow rail section. After the boat has served its purpose on a body of water it is returned to its initial configuration by removing the inverted U-shaped members and seats, and nesting the sections one within the other, and the nested assembly then being in a compact configuration and capable of being transported as such in an automobile or station wagon.

BRIEF DESCRIPTION OF THE DRAWING

FIG. 1 is a perspective view of the multi-section boat assembly, with the bow, stern and intermediate sections interlocking together to provide a buoyant, stable boat;

FIG. 2 is a top plan view of the multi-section boat shown in FIG. 1;

FIG. 3 is a fragmentary, longitudinal cross sectional view of the assembled boat taken on the line 3—3 of FIG. 2;

FIG. 4 is the same view as shown in FIG. 3, but with the bow and intermediate sections being separated from one another prior to being disposed in interlocking relationship;

FIG. 5 is a transverse cross sectional view of a side portion of the boat taken on the line 5—5 of FIG. 3;

FIG. 6 is a fragmentary longitudinal cross sectional view of a rail portion of the bow and intermediate section taken on the line 6—6 of FIG. 2; and FIG. 7 is a top plan view of the multi-section boat assembly arranged in a nested configuration and suitable for transportation in either an automobile or station wagon.

DESCRIPTION OF THE PREFERRED EMBODIMENT

The multi-section boat assembly A that is preferably fabricated from a light weight sheet metal such as aluminum or the like is shown in FIG. 1 in an expanded position, with the bow, stern and intermediate sections interlocking end-to-end to provide a stable buoyant boat, and in FIG. 7 the same assembly of sections is shown nested one within the other in a compact configuration for transportation on land to a desired body of water. The boat assembly A shown in FIGS. 1 and 7 includes a bow section B, a stern section C, and at least one intermediate section that is disposed therebetween, with the sections capable of being interlocked to one another end-to-end as later will be described in detail. The bow section B, as can best be seen in FIG. 1, includes a trapezoidal, flat bottom 10 that has a first transverse forward edge 12 and rear, transverse edge 14. The bottom 10 has a pair of side edges 16 that taper rearwardly and inwardly from the first forward edge 12 to the rearward transverse edge 14. A pair of side walls 18 extend upwardly from the side edges 16, with the side walls 18 including forwardly disposed generally triangular shaped sections **18*a* as shown in FIG. 1. A transverse first sheet 20 extends between the lower edges of the sections 18*a*. The upper horizontal edges of the pair of sections 18*a* are connected by a horizontal rigid member 22, which in cooperation with a second vertically disposed transverse sheet 24 cooperate to define a compartment 26 in which sporting gear or a bait tank may be disposed if desired. Access to the compartment 26 is by a door 28 that is pivotally connected to the horizontal member 22 by hinges 30 as shown in FIG. 2. A first engageable transverse wall 32 extends between the side walls 18 as can be seen in FIG. 3 but is substantially less in height than the sidewalls. The first transverse engageable wall 32 is secured by welding beads 34 or the like to the bottom 10. The first engageable transverse wall 32** that is formed from sheet material has the upper portion shaped to define a transverse beam 32*a* of generally rectangular cross section. The lower portion of the first engageable transverse wall 32 defines an upwardly and rearwardly extending triangular section 32*b*, which is best seen in FIG. 4.

The intermediate section D as can best be seen in FIGS. 1, 3 and 4, includes a flat trapezoidal bottom 36 that has a transverse first forward edge 38 and a second rearward transverse edge 40 and a pair of rearwardly and inwardly tapering side edges 42 that extend between the forward edge 38 and rearward edge 40. A pair of side walls 44 extend upwardly from the side edges 42 as best seen in FIG. 1. A first transverse engaging wall 46 best seen in FIGS. 3 and 4 extends between the side walls 44 of the intermediate section D and is secured to the bottom 36. The wall 46 includes an upwardly disposed L-shaped section 46*a*, a downwardly extending vertical wall 46*b* and the wall 46*b* on the lower end developing into an upwardly and rearwardly extending section 46*c* that is secured to the transverse wall 46. The section 46*a* and the wall 46*b* cooperate to define a transversely extending engaging member that may be pivoted into engagement with the first engageable wall 32 as shown in FIG. 3 to removably hold the bow section B and intermediate section D in rigid end-to-end relationship as shown in FIG. 3. Two laterally spaced inverted U-shape members 48 are provided that have horizontal top edges 50 that are rigidly secured to the under surface of a transverse rectangular seat 52 which seat is preferably formed from sheet metal and has downturned edges 54 that on the lower extremity thereof develop into inwardly extending tabs 56. The U-shaped members when slid downwardly over the first engageable wall 32 and first engaging wall 46 not only serve to removably hold them together in interlocking relationship, but also serve as a support for the transverse seat 52.

The stern section C as best seen in FIGS. 1 and 2 includes a flat trapezoidal bottom 58 that has a forward transverse edge 60 and rearward transverse edge 62. A pair of rearwardly and inwardly extending side edges 64 of the bottom 58 have a pair of side walls 66 extending upwardly therefrom, with the side walls on their rearward ends developing into a transverse transom 68 that has a recess central portion 70 formed therein, and this transom capable of supporting an outboard motor (not shown). The rearward portion of the intermediate section D has a first engageable wall (not shown) that is identical to the engageable wall 32 previously described that removably interlock with an engaging wall 46 supported on the forward part of the stern section C, which engaging wall is identical to the engaging wall 46 previously described. The engageable and engaging walls 32 and 46 when interlocked in the manner previously described and as shown in FIG. 2 are held in the interlock position by a second pair of inverted U-shaped members 48 that support a second transverse seat 52 therebetween. The intermediate section D and stern section C have pairs of forwardly extending wings 44*a* and 66*a* supported from the exterior surfaces of the side walls 44 and 66 thereof. The pair of wings 44*a* when the intermediate section D is interlocked to the bow section B are in pressure sealing contact with the exterior surfaces of the side walls 18. Likewise, when the stern section C is interlocked to the intermediate section D as shown in FIG. 2, the wings 66*a* slidably and sealingly engage the rearward external surfaces of the side walls 44.

The pairs of side walls 18, 44 and 66 on the upper ends thereof develop into longitudinally extending axially aligned hollow rails 18*b*, 44*b* and 66*b*. The intermediate section D has the rails 44*b* thereof supporting slide bolts 72 in the end portion thereof which as can be seen in FIG. 6 may be removably extended into the adjoining rail portions to add longitudinal rigidity to the assembled boat as shown in FIG. 1. The slide bolts 72 have handles 74 projecting upwardly therefrom, which handles are slidably movable in elongate slots 76 formed in the end portions of the pair of rails 44*b*.

The U-shape members 48 are connected to the seat 52 as can best be seen in FIG. 5 by hinges 78 and as a result may be pivoted to a position substantially parallel to the seat when not in use.

The manner by which the bow section B, the stern section C and the intermediate section D are removably interlocked to one another to define the boat A has previously been described and need not be repeated. When it is desired to dismantle the boat and assemble it into a compact configuration, the previously described operation is reversed. The bow section B is of such size as may be seen in FIG. 7 that the intermediate section D may be nested therein, and the stern section C in turn nested within the intermediate section D. The U-shape members 48 are pivoted to parallel positions relative to the seat 52, with the seat then being nested between the bow section B, stern section C and intermediate section D as illustrated in FIG. 7.

The use and operation of the invention has been described previously in detail and need not be repeated.

We claim:

1. A compact portable multi-section boat assembly in which the sections thereof may nest one within the other for transportation or to be disposed end-to-end in removable interlocking relationship to provide a boat, said assembly including:

a. a bow section that includes a flat first trapezoidal bottom that has forward and rearward transverse edges between which a pair of rearwardly and inwardly extending side edges extend, a bow member that extends upwardly and forwardly from said forward edge, a pair of first sidewalls that project upwardly from said side edges and are connected to said bow member, and a transverse engageable wall that is secured to said rearward edge of said bottom and the rearward edges of said side walls;

b. an intermediate section that includes a flat second trapezoidal bottom that has forward and rearward transverse edges and a pair of rearwardly and inwardly extending side edges, a pair of second sidewalls that project upwardly from said side edges of said second bottom, a transverse engaging wall that is secured to the forward ends of said second pair of side walls and to said forward transverse edge of said second bottom, a transverse engageable wall that extends between the rearward ends of said second pair of side walls and said rearward transverse edge of said second bottom;

c. a stern section that includes a flat third trapezoidal bottom that has forward and rearward transverse edges and a pair of rearwardly and inwardly extending side edges, a pair of third side walls that project upwardly from said side edges of said third bottom, a transverse engaging wall that is secured to the forward ends of said third pair of sidewalls and to said forward transverse edge of said third bottom, and a transom that is secured to said rearward edge of said third bottom and to rearward edges of said third side walls, said intermediate section capable of being disposed between said bow section and stern section, with said engageable transverse wall of said bow section and engaging transverse wall of said intermediate section when pivoted relative to one another capable of removably interlocking to hold said bow section and intermediate section in end-to-end longitudinal relationship, and said engaging wall of said stern section capable of interlocking with said engageable wall of said intermediate section when pivoted relative thereto to removably hold said stern section in end-to-end longitudinal relationship with said intermediate section;

d. first means for slidably engaging said engageable and engaging transverse walls to maintain the latter in interlocked relationship, with said first means also serving a second function of providing seats for the user of said boat; and e. second means for longitudinally reinforcing said bow, stern and intermediate sections when they are removably interlocked to define a boat, with said bow, intermediate and stern sections being of such transverse area that they may be nested one within the other when said boat assembly is being transported on land and said second means including:

1. a plurality of axially alignable hollow rails on the upper extremities of the pairs of side walls of said bow, intermediate and stern sections that extend outwardly therefrom; and
2. a plurality of slide bolts that extend between and removably engage said hollow rails when said bow, intermediate and stern sections are longitudinally aligned end-to-end to define a boat.

2. An assembly as defined in claim 1 in which said first means includes:

f. two rigid elongate rectangular seats; and g. two sets of inverted U-shaped rigid members, with each of said sets secured to one of said seats and extending downwardly therefrom to removably engage one of said engageable and engaging walls when said engageable and engaging walls are in interlocking engagement.

3. An assembly as defined in claim 2 in which said sets of inverted U-shaped members are pivotally connected to said seats.

4. An assembly as defined in claim 1 which in addition includes:

f. compartment defining means defined in said bow section adjacent the forward extremity thereof.

* * * * *